US010251519B2

(12) United States Patent
Conrad

(10) Patent No.: US 10,251,519 B2
(45) **Date of Patent: *Apr. 9, 2019**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 295 days.

This patent is subject to a terminal disclaimer.

(21) Appl. No.: 15/057,666

(22) Filed: Mar. 1, 2016

(65) Prior Publication Data

US 2016/0174786 A1 Jun. 23, 2016

Related U.S. Application Data

(63) Continuation-in-part of application No. 14/933,057, filed on Nov. 5, 2015, now Pat. No. 10,136,778, which is a continuation of application No. 14/822,211, filed on Aug. 10, 2015, now Pat. No. 9,888,817.

(60) Provisional application No. 62/093,189, filed on Dec. 17, 2014.

(51) Int. Cl.
*A47L 5/22* (2006.01)

(52) U.S. Cl.
CPC ..... *A47L 5/225* (2013.01); *A47L 5/22* (2013.01)

(58) Field of Classification Search
CPC ..... A47L 5/225; A47L 5/22; A47L 11/4069; A47L 11/204; A47L 11/4094
See application file for complete search history.

(56) References Cited

U.S. PATENT DOCUMENTS

| | | | |
|---|---|---|---|
| 911,258 | A | 2/1909 | Neumann |
| 1,600,762 | A | 9/1926 | Hawley |
| 1,797,812 | A | 3/1931 | Waring |
| 1,898,608 | A | 2/1933 | Alexander |
| 1,937,765 | A | 12/1933 | Ward |
| 2,015,464 | A | 9/1935 | Saint Jacques |
| 2,152,114 | A | 3/1939 | Van Tongeren |

(Continued)

FOREIGN PATENT DOCUMENTS

| | | |
|---|---|---|
| AU | 112778 | 4/1940 |
| CA | 1077412 A1 | 5/1980 |

(Continued)

OTHER PUBLICATIONS

English machine translation of CN101108081A published on Jan. 23, 2008.

(Continued)

*Primary Examiner* — Robert J Scruggs
(74) *Attorney, Agent, or Firm* — Philip C. Mendes da Costa; Bereskin & Parr LLP, S.E.N.C.R.L., s.r.l.

(57) ABSTRACT

A surface cleaning apparatus comprises a surface cleaning head, an upright section movably mounted to the surface cleaning head between a storage position and a floor cleaning position and a hand vacuum cleaner removably mounted to the upright section wherein the surface cleaning head has a first suction motor and the hand vacuum cleaner has a second suction motor, the first suction motor and second suction motor co-operate to convey air through the surface cleaning apparatus.

27 Claims, 7 Drawing Sheets

(56) References Cited

U.S. PATENT DOCUMENTS 2,542,634 A 2/1951 Davis
2,678,110 A 5/1954 Madsen
2,731,102 A 1/1956 James
2,811,219 A 10/1957 Wenzl
2,846,024 A 8/1958 Bremi
2,913,111 A 11/1959 Rogers
2,917,131 A 12/1959 Evans
2,937,713 A 5/1960 Stephenson
2,942,691 A 6/1960 Dillon
2,942,692 A 6/1960 Benz
2,946,451 A 7/1960 Culleton
2,952,330 A 9/1960 Winslow
2,981,369 A 4/1961 Yellott
3,032,954 A 5/1962 Racklyeft
3,085,221 A 4/1963 Kelly
3,130,157 A 4/1964 Kelsall
3,200,568 A 8/1965 McNeil
3,204,772 A 9/1965 Ruxton
3,217,469 A 11/1965 Eckert
3,269,097 A 8/1966 German
3,320,727 A 5/1967 Farley
3,372,532 A 3/1968 Campbell
3,426,513 A 2/1969 Bauer
3,518,815 A 7/1970 Peterson
3,530,649 A 9/1970 Porsch
3,543,325 A 12/1970 Hamrick et al.
3,561,824 A 2/1971 Homan
3,582,616 A 6/1971 Wrob
3,675,401 A 7/1972 Cordes
3,684,093 A 8/1972 Kono
3,822,533 A 7/1974 Oranje
3,898,068 A 8/1975 McNeil et al.
3,933,450 A 1/1976 Percevaut
3,988,132 A 10/1976 Oranje
3,988,133 A 10/1976 Schady
4,097,381 A 6/1978 Ritzler
4,187,088 A 2/1980 Hodgson
4,218,805 A 8/1980 Brazier
4,236,903 A 12/1980 Malmsten
4,307,485 A 12/1981 Dessig
4,373,228 A 2/1983 Dyson
4,382,804 A 5/1983 Mellor
4,409,008 A 10/1983 Solymes
4,486,207 A 12/1984 Baillie
4,494,270 A 1/1985 Ritzau et al.
4,523,936 A 6/1985 Disanza, Jr.
4,678,588 A 7/1987 Shortt
4,700,429 A 10/1987 Martin et al.
4,744,958 A 5/1988 Pircon
4,778,494 A 10/1988 Patterson
4,803,753 A * 2/1989 Palmer ..... A47L 11/30 15/320
4,826,515 A 5/1989 Dyson
D303,173 S 8/1989 Masakata et al.
4,853,008 A 8/1989 Dyson
4,853,011 A 8/1989 Dyson
4,853,111 A 8/1989 MacArthur et al.
4,905,342 A 3/1990 Ataka
4,944,780 A 7/1990 Usmani
4,980,945 A 1/1991 Bewley
5,054,157 A * 10/1991 Werner ..... A47L 5/32 15/328
5,078,761 A 1/1992 Dyson
5,080,697 A 1/1992 Finke
5,090,976 A 2/1992 Dyson
5,129,125 A 7/1992 Gamou et al.
5,224,238 A 7/1993 Bartlett
5,230,722 A 7/1993 Yonkers
5,254,019 A 10/1993 Noschese
5,267,371 A 12/1993 Solerm et al.
5,287,591 A 2/1994 Rench et al.
5,307,538 A 5/1994 Rench et al.
5,309,600 A 5/1994 Weaver et al.
5,309,601 A 5/1994 Hampton et al.
5,347,679 A 9/1994 Saunders et al.
5,363,535 A 11/1994 Rench et al.
5,481,780 A * 1/1996 Daneshvar ..... A47L 7/04 15/339
5,515,573 A 5/1996 Frey
5,599,365 A 2/1997 Alday et al.
D380,033 S 6/1997 Masterton et al.
5,709,007 A 1/1998 Chiang
5,755,096 A 5/1998 Holleyman
5,815,878 A 10/1998 Murakami et al.
5,815,881 A 10/1998 Sjoegreen
5,858,038 A 1/1999 Dyson et al.
5,858,043 A 1/1999 Geise
5,893,938 A 4/1999 Dyson et al.
5,935,279 A 8/1999 Kilstroem
5,950,274 A 9/1999 Kilstrom
5,970,572 A 10/1999 Homas
6,071,095 A 6/2000 Verkaar
6,071,321 A 6/2000 Trapp et al.
6,080,022 A 6/2000 Shaberman et al.
6,122,796 A * 9/2000 Downham ..... A47L 5/00 15/328
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,260,234 B1 7/2001 Wright et al.
6,345,408 B1 2/2002 Nagai et al.
6,406,505 B1 6/2002 Oh et al.
6,434,785 B1 8/2002 Vandenbelt et al.
6,440,197 B1 8/2002 Conrad et al.
6,502,278 B2 1/2003 Oh et al.
6,519,810 B2 2/2003 Kim
6,531,066 B1 3/2003 Saunders et al.
6,553,612 B1 4/2003 Dyson et al.
6,553,613 B2 4/2003 Onishi et al.
6,560,818 B1 5/2003 Hasko
6,581,239 B1 6/2003 Dyson et al.
6,599,338 B2 7/2003 Oh et al.
6,599,350 B1 7/2003 Rockwell et al.
6,613,316 B2 9/2003 Sun et al.
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,712,868 B2 3/2004 Murphy et al.
6,732,403 B2 5/2004 Moore et al.
6,746,500 B1 6/2004 Park et al.
6,782,583 B2 8/2004 Oh
6,782,585 B1 8/2004 Conrad et al.
6,810,558 B2 11/2004 Lee
6,818,036 B1 11/2004 Seaman
6,833,015 B2 12/2004 Oh et al.
6,868,578 B1 3/2005 Kasper
6,874,197 B1 4/2005 Conrad
6,896,719 B2 5/2005 Coates et al.
6,929,516 B2 8/2005 Brochu et al.
6,968,596 B2 11/2005 Oh et al.
6,976,885 B2 12/2005 Lord
7,113,847 B2 9/2006 Chumura et al.
7,128,770 B2 10/2006 Oh et al.
7,160,346 B2 1/2007 Park
7,162,770 B2 1/2007 Davidshofer
7,175,682 B2 2/2007 Nakai et al.
7,198,656 B2 4/2007 Takemoto et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,426,768 B2 9/2008 Peterson et al.
7,429,284 B2 9/2008 Oh
7,448,363 B1 11/2008 Rasmussen et al.
7,449,040 B2 11/2008 Conrad et al.

(56) References Cited

U.S. PATENT DOCUMENTS 7,485,164 B2 2/2009 Jeong et al.
7,488,363 B2 2/2009 Jeong et al.
7,547,337 B2 6/2009 Oh
7,547,338 B2 6/2009 Kim et al.
7,563,298 B2 7/2009 Oh
7,565,853 B2 8/2009 Arnold et al.
7,588,616 B2 9/2009 Conrad et al.
7,597,730 B2 10/2009 Yoo et al.
7,628,831 B2 12/2009 Gomiciaga-Pereda et al.
7,691,161 B2 4/2010 Oh et al.
7,717,973 B2 5/2010 Oh et al.
7,740,676 B2 6/2010 Burnham et al.
7,770,256 B1 8/2010 Fester
7,776,120 B2 8/2010 Conrad
7,779,506 B2 8/2010 Kang et al.
7,803,207 B2 9/2010 Conrad
7,805,804 B2 10/2010 Loebig
7,811,349 B2 10/2010 Nguyen
7,867,308 B2 1/2011 Conrad
7,882,593 B2 2/2011 Beskow et al.
7,922,794 B2 4/2011 Morphey
7,931,716 B2 4/2011 Oakham
7,938,871 B2 5/2011 Lloyd
7,958,598 B2 6/2011 Yun et al.
7,979,959 B2 7/2011 Courtney
7,996,956 B2 8/2011 Wood et al.
8,021,453 B2 9/2011 Howes
8,062,398 B2 11/2011 Luo et al.
8,100,999 B2 1/2012 Ashbee et al.
8,101,001 B2 1/2012 Qian
8,117,712 B2 2/2012 Dyson et al.
8,146,201 B2 4/2012 Conrad
8,151,407 B2 4/2012 Conrad
8,152,877 B2 4/2012 Greene
8,156,609 B2 4/2012 Milne et al.
8,161,599 B2 4/2012 Griffith et al.
8,225,456 B2 7/2012 Håkan et al.
8,484,799 B2 7/2013 Conrad
8,673,487 B2 3/2014 Churchill
9,192,269 B2 11/2015 Conrad
9,675,218 B2 6/2017 Kim et al.
2002/0011050 A1 1/2002 Hansen et al.
2002/0011053 A1 1/2002 Oh
2002/0062531 A1 5/2002 Oh
2002/0088208 A1 7/2002 Lukac et al.
2002/0112315 A1 8/2002 Conrad
2002/0134059 A1 9/2002 Oh
2002/0134238 A1 9/2002 Conrad et al.
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0045126 A1* 3/2004 Parker ..... A47L 5/28 15/403
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1* 10/2006 Oh ..... A47L 9/1658 55/337
2006/0230723 A1 10/2006 Kim et al.
2006/0230724 A1 10/2006 Han et al.
2006/0236663 A1 10/2006 Oh
2006/0254226 A1 11/2006 Jeon
2006/0278081 A1 12/2006 Han et al.
2006/0288516 A1 12/2006 Sawalski
2007/0067944 A1 3/2007 Kitamura
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0136984 A1 6/2007 Hsu
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0134460 A1 6/2008 Conrad
2008/0134462 A1 6/2008 Jansen et al.
2008/0178416 A1 7/2008 Conrad
2008/0178420 A1 7/2008 Conrad
2008/0190080 A1 8/2008 Oh et al.
2008/0196194 A1 8/2008 Conrad
2008/0196745 A1 8/2008 Conrad
2008/0301903 A1 12/2008 Cunningham et al.
2009/0044372 A1* 2/2009 Knopow ..... A47L 5/14 15/345
2009/0100633 A1 4/2009 Bates et al.
2009/0113659 A1 5/2009 Jeon
2009/0144932 A1 6/2009 Yoo
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0307564 A1 12/2009 Vedantham et al.
2009/0307863 A1 12/2009 Milne et al.
2009/0307864 A1 12/2009 Dyson
2009/0308254 A1 12/2009 Oakham
2009/0313958 A1 12/2009 Gomiciaga-Pereda et al.
2009/0313959 A1 12/2009 Gomiciaga-Pereda et al.
2010/0083459 A1 4/2010 Beskow et al.
2010/0132319 A1 6/2010 Ashbee et al.
2010/0154150 A1 6/2010 McLeod
2010/0175217 A1 7/2010 Conrad
2010/0212104 A1 8/2010 Conrad
2010/0224073 A1 9/2010 Oh et al.
2010/0229321 A1 9/2010 Dyson et al.
2010/0229324 A1 9/2010 Conrad
2010/0229328 A1 9/2010 Conrad
2010/0242210 A1 9/2010 Conrad
2010/0243158 A1 9/2010 Conrad
2010/0293745 A1 11/2010 Coburn
2010/0299865 A1 12/2010 Conrad
2010/0299866 A1 12/2010 Conrad
2011/0023261 A1 2/2011 Proffitt, II et al.
2011/0146024 A1 6/2011 Conrad
2011/0168332 A1 7/2011 Bowe et al.
2011/0219576 A1 9/2011 Conrad
2011/0289719 A1* 12/2011 Han ..... A47L 5/225 15/344

(56) References Cited

U.S. PATENT DOCUMENTS

| | | | | |
|---|---|---|---|---|
| 2012/0023701 | A1* | 2/2012 | Lenkiewicz | A47L 9/1666 15/352 |
| 2012/0060322 | A1 | 3/2012 | Simonelli et al. | |
| 2012/0079671 | A1 | 4/2012 | Stickney et al. | |
| 2012/0216361 | A1 | 8/2012 | Millington et al. | |
| 2012/0222245 | A1 | 9/2012 | Conrad | |
| 2012/0222260 | A1 | 9/2012 | Conrad | |
| 2012/0222262 | A1 | 9/2012 | Conrad | |
| 2013/0160232 | A1 | 6/2013 | Peace | |
| 2014/0137362 | A1 | 5/2014 | Smith | |
| 2014/0137363 | A1 | 5/2014 | Wilson | |
| 2014/0137364 | A1 | 5/2014 | Stickney et al. | |
| 2014/0182080 | A1 | 7/2014 | Lee et al. | |
| 2014/0208538 | A1 | 7/2014 | Visel et al. | |
| 2014/0237956 | A1 | 8/2014 | Conrad | |
| 2015/0135474 | A1 | 5/2015 | Gidwell | |
| 2015/0230677 | A1 | 8/2015 | Andrikanish | |
| 2015/0297050 | A1 | 10/2015 | Marsh et al. | |
| 2016/0113460 | A1 | 4/2016 | Williams et al. | |

FOREIGN PATENT DOCUMENTS

| | | | |
|---|---|---|---|
| CA | 1218962 | A | 3/1987 |
| CA | 2450450 | A1 | 12/2004 |
| CA | 2484587 | A1 | 4/2005 |
| CA | 2438079 | C | 8/2009 |
| CA | 2658014 | A1 | 9/2010 |
| CA | 2659212 | A1 | 9/2010 |
| CN | 1336154 | A | 2/2002 |
| CN | 1434688 | A | 8/2003 |
| CN | 1493244 | A | 5/2004 |
| CN | 1875846 | A | 12/2006 |
| CN | 1875855 | A | 12/2006 |
| CN | 1887437 | A | 1/2007 |
| CN | 101061932 | A | 10/2007 |
| CN | 101108081 | A | 1/2008 |
| CN | 101108106 | A | 1/2008 |
| CN | 101108110 | A | 1/2008 |
| CN | 201290642 | Y | 8/2009 |
| CN | 202739907 | U | 2/2013 |
| CN | 202932850 | U | 5/2013 |
| CN | 204363891 | U | 6/2015 |
| CN | 105816104 | A | 8/2016 |
| CN | 205671986 | U | 11/2016 |
| DE | 875134 | C | 4/1953 |
| DE | 9216071.9 | U1 | 2/1993 |
| DE | 4232382 | C1 | 3/1994 |
| DE | 10056935 | C2 | 1/2003 |
| DE | 69907201 | T2 | 2/2004 |
| DE | 60201666 | T2 | 6/2006 |
| DE | 60211663 | T2 | 5/2007 |
| DE | 112010001135 | T5 | 8/2012 |
| DE | 102012211246 | A1 | 1/2014 |
| EP | 0489498 | A1 | 6/1992 |
| EP | 493950 | B1 | 7/1992 |
| EP | 1200196 | B1 | 6/2005 |
| EP | 1779761 | A2 | 5/2007 |
| EP | 1815777 | A1 | 8/2007 |
| EP | 1594386 | B1 | 4/2009 |
| EP | 1676516 | B1 | 1/2010 |
| EP | 1629758 | A3 | 2/2010 |
| EP | 2308360 | A2 | 4/2011 |
| EP | 2848173 | A1 | 3/2015 |
| FR | 2812531 | B1 | 11/2004 |
| GB | 700791 | A | 12/1953 |
| GB | 1111074 | A | 4/1968 |
| GB | 2035787 | B | 10/1982 |
| GB | 2163703 | A | 5/1986 |
| GB | 2268875 | A | 1/1994 |
| GB | 2282979 | A | 4/1995 |
| GB | 2307849 | A | 6/1997 |
| GB | 2365324 | B | 7/2002 |
| GB | 2440111 | A | 1/2008 |
| GB | 2465781 | A | 6/2010 |
| GB | 2466290 | A | 6/2010 |
| GB | 2441962 | B | 3/2011 |
| GB | 2508035 | | 5/2014 |
| JP | 61131720 | A | 6/1986 |
| JP | 2000140533 | A | 5/2000 |
| JP | 2002085297 | A | 3/2002 |
| JP | 2003135335 | A | 5/2003 |
| JP | 2005040246 | A | 2/2005 |
| JP | 2006102034 | A | 4/2006 |
| JP | 2008206613 | A | 9/2008 |
| JP | 2009261501 | A | 11/2009 |
| JP | 2010081968 | A | 4/2010 |
| JP | 2010178773 | A | 8/2010 |
| JP | 2010220632 | A | 10/2010 |
| JP | 2011189132 | A | 9/2011 |
| JP | 2011189133 | A | 9/2011 |
| JP | 2013086228 | A | 5/2013 |
| KR | 1020010045598 | A | 6/2001 |
| KR | 1020020067489 | A | 8/2002 |
| KR | 1020020085478 | A | 11/2002 |
| KR | 1020040050174 | A | 6/2004 |
| KR | 1020060008365 | A | 1/2006 |
| KR | 1020060118795 | A | 11/2006 |
| KR | 1020060118800 | A | 11/2006 |
| KR | 1020060118802 | A | 11/2006 |
| KR | 1020060118803 | A | 11/2006 |
| KR | 1020060122249 | A | 11/2006 |
| KR | 1020060125952 | A | 12/2006 |
| KR | 1020060125954 | A | 12/2006 |
| KR | 1020100084127 | A | 7/2010 |
| WO | 1980002561 | A1 | 11/1980 |
| WO | 9627446 | A1 | 9/1996 |
| WO | 97/20492 | A1 | 6/1997 |
| WO | 9809121 | A1 | 3/1998 |
| WO | 9843721 | A1 | 10/1998 |
| WO | 01/07168 | A1 | 2/2001 |
| WO | 0147247 | A2 | 6/2001 |
| WO | 0147247 | A3 | 11/2001 |
| WO | 0217766 | A2 | 3/2002 |
| WO | 2004069021 | A1 | 8/2004 |
| WO | 2006026414 | A3 | 3/2006 |
| WO | 2006076363 | A2 | 7/2006 |
| WO | 2006076363 | A3 | 12/2006 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008035032 | A2 | 3/2008 |
| WO | 2008070973 | A1 | 6/2008 |
| WO | 2008088278 | A2 | 7/2008 |
| WO | 2008135708 | A1 | 11/2008 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A1 | 12/2010 |
| WO | 2011054106 | A1 | 5/2011 |
| WO | 2012042240 | A1 | 4/2012 |
| WO | 2012117231 | A1 | 9/2012 |
| WO | 2015129387 | A1 | 9/2015 |
| WO | 2016065151 | A1 | 4/2016 |
| WO | 2017046557 | A1 | 3/2017 |
| WO | 2017046559 | A1 | 3/2017 |
| WO | 2017046560 | A1 | 3/2017 |

OTHER PUBLICATIONS

English machine translation of CN101108106A published on Jan. 23, 2008.

English machine translation of CN101108110A published on Jan. 23, 2008.

English machine translation of CN1336154A published on Feb. 20, 2002.

English machine translation of CN1434688A published on Aug. 6, 2003.

English machine translation of CN1875846A published on Dec. 13, 2006.

(56) References Cited

OTHER PUBLICATIONS

English machine translation of CN1875855A published on Dec. 13, 2006.
English machine translation of CN201290642Y published on Aug. 19, 2009.
English machine translation of DE10056935C2 published on Jan. 16, 2003.
English machine translation of DE102012211246A1 published on Jan. 2, 2014.
English machine translation of DE112010001135T5 published on Aug. 2, 2012.
English machine translation of DE60201666T2 published on Jun. 1, 2006.
English machine translation of DE60211663T2 published on May 10, 2007.
English machine translation of DE69907201T2 published on Feb. 5, 2004.
English machine translation of EP1815777A1 published on Aug. 8, 2007.
English machine translation of JP2003135335A published on May 13, 2003.
English machine translation of JP2005040246A published on Feb. 17, 2005.
English machine translation of JP2009261501A published on Nov. 12, 2009.
English machine translation of JP2010081968A published on Apr. 15, 2010.
English machine translation of KR1020010045598A published on Jun. 5, 2001.
English machine translation of KR1020020067489A published on Aug. 22, 2002.
English machine translation of KR1020020085478A published on Nov. 16, 2002.
English machine translation of KR1020040050174A published on Jun. 16, 2004.
English machine translation of KR1020060008365A published on Jan. 26, 2006.
English machine translation of KR1020060118795A published on Nov. 24, 2006.
English machine translation of KR1020060118800A published on Nov. 24, 2006.
English machine translation of KR1020060118802A published on Nov. 24, 2006.
English machine translation of KR1020060118803A published on Nov. 24, 2006.
English machine translation of KR1020060122249A published on Nov. 30, 2006.
English machine translation of KR1020060125952A published on Dec. 7, 2006.
English machine translation of KR1020060125954A published on Dec. 7, 2006.
English machine translation of KR1020100084127A published on Jul. 23, 2010.
English machine translation of CN204363891U published on Jun. 3, 2015.
English machine translation of JP2008206613A published on Sep. 11, 2008.
English machine translation of JP2002085297A published on Mar. 26, 2002.
English machine translation of WO2015129387A1 published on Sep. 3, 2015.
English machine translation of CN202739907U published on Feb. 20, 2013.
English machine translation of CN205671986U published on Nov. 9, 2016.
English machine translation of CN105816104A published on Aug. 3, 2016.
English machine translation of JP2013086228A published on May 13, 2013.
English machine translation of JP2006102034A published on Apr. 20, 2006.
Combined Search and Examination Report under Sections 17 & 18(3) received in connection to the corresponding GB Patent Application No. 1522195.5 dated Jun. 16, 2016.
Combined Search and Examination Report under Sections 17 & 18(3) received in connection to the corresponding GB Patent Application No. 1706875.0 dated May 25, 2017.
International Preliminary Examination Report on International application No. PCT/CA2015/051332, dated Mar. 7, 2016.
International Preliminary Report on Patentability in International Application No. PCT/CA2015/051332 dated Jun. 29, 2017.
International Preliminary Report on Patentability, dated Sep. 16, 2008 for International application No. PCT/CA2007/000380.
International Search Report and Written Opinion received in connection to International Patent Application No. PCT/CA2014/000133, dated May 26, 2014.
Supplementary European Search Report, dated Jun. 16, 2009, as received on the corresponding EP application No. 07719394.4.
International Search Report and Written Opinion received in connection to International patent application No. PCT/CA2017/050436, dated Jul. 21, 2017.
International Search Report and Written Opinion received in connection to International patent application No. PCT/CA2017/050014, dated Apr. 5, 2017.
The Office Action received in connection to the corresponding Chinese Patent Application No. 200880126486.6 dated Mar. 23, 2012.
The Office Action received in connection to the corresponding U.S. Appl. No. 12/720,901 dated Jun. 10, 2011.
The Office Action received in connection to the related Chinese Patent Application No. 00813438.3 dated Jul. 11, 2003.
Handbook of Air Pollution Prevention and Contriol, pp. 397-404, 2002.
European Communication pursuant to Article 94(3) on European Patent Application No. 04078261.7, dated Apr. 24, 2012.
European Communication pursuant to Article 94(3) on European Patent Application No. 04078261.7, dated Feb. 26, 2010.
International Preliminary Examination Report on International application No. PCT/CA00/00873, dated Oct. 26, 2001.
Office Action dated Jul. 7, 2010, for Canadian Patent Application No. 2,675,714.
International Search Report and Written Opinion, dated Apr. 21, 2008, for International application No. PCT/CA2007/002211.
International Search Report and Written Opinion, dated Oct. 19, 2015, for International application No. PCT/CA2015/050661.
United States Office Action, dated Feb. 16, 2011, for U.S. Appl. No. 11/953,292.
United States Office Action, dated Jul. 22, 2010, for U.S. Appl. No. 11/953,292.
Euro-Pro Shark Cordless Hand Vac Owner's Manual, published in 2002.

* cited by examiner

SURFACE CLEANING APPARATUS

CROSS REFERENCE TO RELATED APPLICATIONS

This application is a continuation-in-part of co-pending U.S. patent application Ser. No. 14/933,057 filed Nov. 5, 2015, which itself was a continuation of co-pending U.S. patent application Ser. No. 14/822,211 filed Aug. 10, 2015, which claimed priority from U.S. Provisional Patent Application No. 62/093,189, filed Dec. 17, 2014. The entirety of these applications is hereby incorporated by reference.

FIELD

This disclosure relates to the field of surface cleaning apparatus. In some aspects, this disclosure relates to a type of stick vacuum cleaner wherein a hand vacuum cleaner is removably mounted to a drive handle (e.g., a rigid up flow conduit) and two suction motors provide motive power to draw dirty air through the surface cleaning apparatus.

INTRODUCTION

Various types of surface cleaning apparatus are known. These include upright vacuum cleaner, stick vacuum cleaners, hand vacuum cleaners and canister vacuum cleaners. Stick vacuum cleaners and hand vacuum cleaners are popular as they tend to be smaller and may be used to clean a small area or when a spill has to be cleaned up. Hand vacuum cleaners or handvacs are advantageous as they are lightweight and permit above floor cleaning and cleaning in hard to reach locations. However, in order to provide good cleaning efficiency, particularly when provided as part of a stick vacuum cleaner, the hand vacuum cleaner may be heavy due to the suction motor which is required.

SUMMARY

In accordance with one aspect of this disclosure, a surface cleaning apparatus is provided which has a surface cleaning head and a vacuum cleaner unit (e.g., a hand vacuum cleaner) and two suction motors wherein one of the suction motors is part of the vacuum cleaning unit and the other of the suction motors is provided external to the vacuum cleaning unit. For example, the surface cleaning apparatus may be an upright vacuum cleaner or a stick vacuum cleaner with a vacuum cleaner unit removably mounted thereto. The vacuum cleaning unit may be any portable surface cleaning apparatus that comprises a suction motor and an air treatment member. For example, the vacuum cleaning unit may be a hand vacuum cleaner comprising at least one cyclonic cleaning stage and a suction motor and, optionally one or more pre-motor filters (each of which may be a porous filter media) and one or more post motor filters (each of which may be a porous filter media).

An advantage of this design is that the weight of the hand vacuum cleaner may be reduced. When a hand vacuum cleaner is used by itself or with an accessory cleaning tool, such as a crevice tool, the air flow path from the inlet of the hand vacuum cleaner or the accessory tool to the clean air outlet of the hand vacuum cleaner has a backpressure. Therefore, a suction motor is selected to provide a desired air flow at the inlet. However, when the hand vacuum cleaner is used as part of a surface cleaning apparatus, (e.g., air enters a surface cleaning head and travels through a rigid upright conduit to the hand vacuum cleaner air inlet), the backpressure is increased and the air flow at the dirty air inlet of the surface cleaning head will be reduced. Therefore, the cleanability of the surface cleaning apparatus is reduced. In order to account for the reduced airflow at the dirty air inlet of the surface cleaning head, a more powerful suction motor may be provided in the hand vacuum cleaner. This will typically increase the weight of the hand vacuum cleaner. In accordance with a first aspect, the surface cleaning apparatus may be provided with two suction motors wherein one of the suction motors is part of the hand vacuum cleaner and the other of the suction motors is provided, e.g., in the surface cleaning head. The hand vacuum cleaner may be provided with a suction motor that provides a desired air flow at the inlet of the hand vacuum cleaner. However, when the hand vacuum cleaner is part of the air flow path of the surface cleaning apparatus, the suction motor in the surface cleaning head enhances the air flow through the surface cleaning apparatus and therefore improves the air flow at the dirty air inlet of the surface cleaning head with a consequential increase in cleanability.

It will be appreciated that a first suction motor may be provided on any portion of the surface cleaning apparatus that remains when the vacuum cleaner unit is removed and a second suction motor may be provided in the vacuum cleaner unit. For example, the surface cleaning apparatus may comprise a surface cleaning head and an upright section moveably (e.g., pivotally) mounted thereto. The first suction motor may be provided in the surface cleaning head or the upright section.

In addition, providing two suction motors may allow the surface cleaning apparatus to be operated at a variety of different power and cleaning levels.

In accordance with this aspect, there is provided a surface cleaning apparatus comprising:

a) a surface cleaning head having a dirty air inlet;
b) an air flow path extending form the dirty air inlet to a clean air outlet;
c) a rigid air flow conduit moveably mounted to the surface cleaning head between a storage position and a floor cleaning position,
d) a first suction motor in the air flow path downstream from the dirty air inlet and disposed in the surface cleaning head or on the rigid air flow conduit; and,
e) a hand vacuum cleaner comprising a handle, an air inlet, an air treatment member having an air treatment member air inlet and a second suction motor downstream from the air treatment member and upstream from the clean air outlet, the hand vacuum cleaner is removably mounted to a downstream end of the rigid air flow conduit, wherein when the hand vacuum cleaner is mounted to the rigid air flow conduit, the handle is drivingly connected to the surface cleaning head.

In some embodiments the first suction motor and second suction motor may co-operate to convey air through the air treatment member to the clear air outlet.

In some embodiments a portion, and preferably all, of the air flow path extending from the first suction motor to the second suction motor may be at a pressure less than atmospheric pressure when the first and second suction motors are in use.

In some embodiments, when the first and second suction motors are in use, the air pressure at the air inlet of the vacuum cleaner unit may be less than atmospheric pressure. For example, the pressure may be less than 2 inches of water, less than 1 inch of water, less than 0.5 inches of water or less than 0.25 inches of water.

In accordance with this aspect, there is provided a surface cleaning apparatus comprising:

a) a surface cleaning head having a dirty air inlet;

b) an air flow path extending form the dirty air inlet to a clean air outlet;

c) an upright section movably mounted to the surface cleaning head, the upright section moveable between a storage position and a floor cleaning position, d) a first suction motor in the air flow path downstream from the dirty air inlet and disposed in one of the surface cleaning head and the upright section; and e) a vacuum cleaner unit in the air flow path downstream from the first suction motor and comprising an air inlet, an air treatment member having an air treatment member air inlet and a second suction motor downstream from the air treatment member and upstream from the clean air outlet, the first suction motor and second suction motor co-operate to convey air through the air treatment member to the clear air outlet.

In some embodiments the vacuum cleaner unit may be detachably mounted to the upright section and the surface cleaning apparatus may be operable in a floor cleaning mode in which the vacuum cleaner unit is mounted to the upright section and the vacuum cleaner unit may be operable in a portable mode wherein the vacuum cleaner unit is detached from the upright section.

In some embodiments apparatus further comprises a power switch on the vacuum cleaner unit, wherein when the vacuum cleaner unit is attached to the upright section, the power switch controls operation of the first suction motor and the second suction motor, and when the vacuum cleaner unit is detached from the upright section, the power switch controls operation of the second suction motor.

In some embodiments the first suction motor is disposed within the surface cleaning head. Alternately or in addition, the surface cleaning head may further comprise a rotatable brush positioned adjacent the dirty air inlet and a brush motor drivingly connected to the rotatable brush. In such a case, the rotatable brush may rotate about a brush axis and the first suction motor may rotate about a first motor axis that is generally parallel to the brush axis or the brush motor may rotate about a brush motor axis that is parallel to the brush axis and the first motor axis.

In some embodiments the surface cleaning head may further comprise an inlet air passage extending from the dirty air inlet to the first suction motor wherein at least a portion of the inlet air passage extends underneath the brush motor.

In some embodiments the vacuum cleaner unit may comprise the clean air outlet and the vacuum cleaning unit may further comprise a pre-motor filter positioned external to the air treatment member and positioned in the air flow path downstream from the air treatment member and upstream from the second suction motor, and a post-motor filter is positioned in the air flow path downstream from the second suction motor and upstream from the clear air outlet.

In some embodiments the air treatment member may comprise one or more cyclones.

In some embodiments a portion, and preferably all, of the air flow path extending from the first suction motor to the second suction motor may be at a pressure less than atmospheric pressure when the first and second suction motors are in use.

In some embodiments, when the first and second suction motors are in use, the air pressure at the air inlet of the vacuum cleaner unit may be less than atmospheric pressure. For example, the pressure may be less than 2 inches of water, less than 1 inch of water, less than 0.5 inches of water or less than 0.25 inches of water.

In some embodiments, when the first and second suction motors are in use, the air pressure at the air treatment member air inlet may be less than atmospheric pressure. For example, the pressure may be less than 2 inches of water, less than 1 inch of water, less than 0.5 inches of water or less than 0.25 inches of water.

In some embodiments a portion of the air flow path between the dirty air inlet and the air treatment member is free from physical media filtration members.

In some embodiments the first suction motor and second suction motor may be independently operable.

In some embodiments the upright section may comprise a rigid wand having an upstream end connected to the surface cleaning head and forming part of the air flow path, the vacuum cleaner unit may comprise a hand vacuum cleaner that is detachably mounted to an opposed downstream end of the rigid wand, and the rigid wand may provide fluid communication between the first suction motor and the vacuum cleaner unit.

In some embodiments the vacuum cleaner unit may further comprise a handle drivingly connected to the surface cleaning head.

In some embodiments, the vacuum cleaner unit may comprise a first power source to provide power to the second suction motor, and the rigid wand may comprise electrical connectors to transfer power from the vacuum cleaner unit to the surface cleaning head to power the first suction motor.

In some embodiments, wherein the vacuum cleaner unit may be detachably mounted to the upright section and further comprise a power switch to control operation of the second suction motor, wherein the power switch may be provided on and detachable with the vacuum cleaner unit, and wherein when the vacuum cleaner unit is mounted to the upper section the power switch may also control operation of the first suction motor.

In some embodiments the vacuum cleaner unit may comprise a first power source to provide power to the second suction motor, and wherein the surface cleaning head may comprise a second power source disposed within the surface cleaning head to provide power to the first suction motor.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Figure 1:
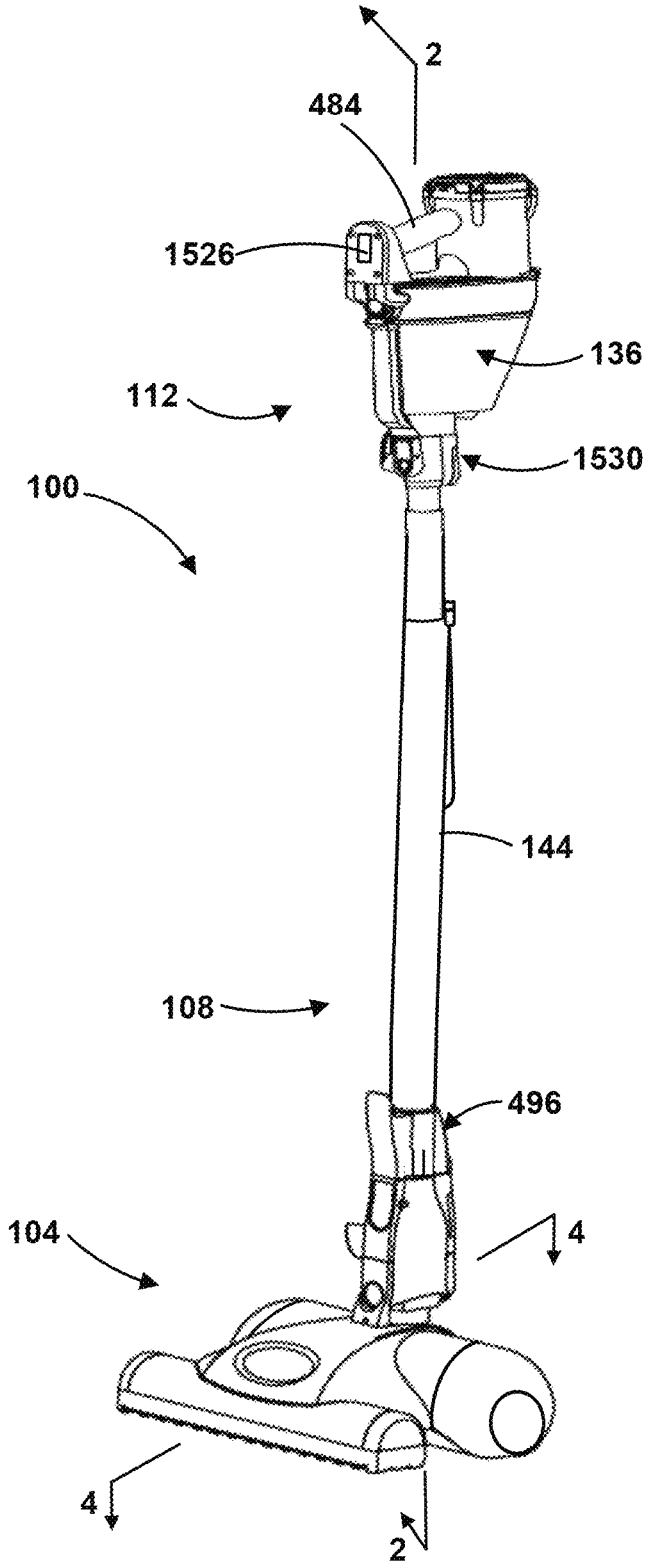
FIG. 1 is a perspective view of one example of a surface cleaning apparatus.

Various apparatuses and methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "mounted" or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly mounted", or "directly fastened" where the parts are connected directly in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

Referring to FIG. 1 one example of a surface cleaning apparatus 100 includes a surface cleaning head 104, an upright section 108, and a portable vacuum cleaner unit in the form of a hand-carriable vacuum cleaner 112 (also referred to herein as handvac or hand vacuum cleaner).

The upright section 108 may be any upright section of a vacuum cleaner known in the vacuum cleaner art. For example, if surface cleaning apparatus 100 is an upright vacuum then upright section 108 may comprise a frame having a driving handle. Alternately, if surface cleaning apparatus 100 is a stick vac type vacuum cleaner, then as exemplified in FIG. 1, the upright section 108 may comprise a rigid air flow conduit or wand 144 that provides airflow communication, and optionally electrical communication, between the handvac 112 and the surface cleaning head 104.

The upright section 108 may be movably and drivingly connected to surface cleaning head 104. For example, upright section 108 may be permanently or removably connected to surface cleaning head 104. For example, rigid wand 144 may be disconnectable from surface cleaning head 104 for use in an above floor cleaning mode wherein the upstream end of rigid wand 144 may function as a cleaning nozzle and/or may have an auxiliary cleaning tool attachable thereto. In alternate embodiments, air may not travel through wand 144. Instead a flexible hose may be used to connect hand vacuum cleaner 112 with surface cleaning head 104.

Upright section 108 may be moveably mounted surface cleaning head 104 for movement from a generally upright storage position to a generally inclined or reclined in use or floor cleaning position. In the illustrated example, the upright section 108 is pivotally connected to the surface cleaning head 104 using a pivot joint 116 which may permit upright section 108 to pivot rearwardly with respect to surface cleaning head 104 about a horizontal axis. Accordingly, upright section 108 may be pivoted rearwardly so as to be positionable in a plurality of reclined floor cleaning positions.

Optionally, the upright section 108 may also be steeringly connected to surface cleaning head 104 for maneuvering surface cleaning head 104. For example, the joint 116 may include a rotatable connection (such that the wand may rotate about its longitudinal wand axis 568) or may include a second pivot connection.

Optionally, the handvac 112 may be removably connected or mounted to upright section 108. When mounted to upright section 108 (a floor cleaning mode), a user may grasp handvac 112 to manipulate upright section 108 to steer surface cleaning head 104 across a surface to be cleaned. Accordingly, when handvac 112 is mounted to upright section 108, the handle 484 on the handvac 112 may be drivingly connected to the surface cleaning head 104 so as to function as the primary, and optionally the only drive handle of surface cleaning apparatus 100.

In the illustrated example the surface cleaning apparatus 100 has at least one dirty air inlet, one clean air outlet, and an airflow path extending between the inlet and the outlet. In the upright cleaning configuration exemplified in FIG. 1, lower end 120 of surface cleaning head 104 includes a dirty air inlet 124, and a rear end 128 of handvac 112 includes a clean air outlet 132. Therefore, in a floor cleaning mode, one example of an airflow path extends from dirty air inlet 124 through surface cleaning head 104, upright section 108, and handvac 112 to clean air outlet 132.

As exemplified, at least one suction motor 204 (also referred to herein as the second suction motor) and at least one air treatment member, which may be the only air treatment members in the apparatus 100, is provided in the handvac 112. In the illustrated example, the air treatment member includes a cyclone bin assembly 136, but alternatively may be configured as any one or more suitable air treatment member, including, for example, one or more cyclones some or all of which may be in parallel, a non-cyclonic air treatment members such as a swirl chamber or settling chamber in which air is introduced other than by a cyclonic air inlet, bags, filters and the like.

Providing the suction motor 204 and at least one air treatment member in the handvac 112 may help facilitate the use of the handvac 112 as an independent, portable vacuum cleaner (with or without rigid wand 144) when disconnected from surface cleaning head 104 and optionally from upright section 108. For example, the handvac 112 may be detached from the upper section 108 and may be used in a portable cleaning mode in which it is independent of the surface cleaning head 104 (i.e. in one example of an above floor cleaning mode).

Preferably, at least one air treatment member is provided upstream of the hand vacuum cleaner suction motor 204 to clean the dirty air before the air passes through the suction motor 204. In this arrangement, the suction motor 204 can be referred to as a clean air motor.

In the illustrated embodiment, the cyclone bin assembly 136 includes a cyclone chamber 184 and a dirt collection region. In some embodiments, the dirt collection region may be a portion (e.g., a lower portion) of the cyclone chamber 184. In other embodiments, the dirt collection region may be a dirt collection chamber 140 that is external the cyclone chamber 184 and separated from the cyclone chamber 184 by a dirt outlet 200 of the cyclone chamber.

In the illustrated example, the wand 114 is an up flow duct that supports the handvac 112 at a fixed distance from the surface cleaning head 104 and may be removable from the surface cleaning head 104 to function as an above floor cleaning wand. In other embodiments, the up flow duct need not be a load supporting member, and the upper portion 108 may include structural support members that do not form part of the air flow path, and all or a portion of up flow duct may be flexible, such as a flexible hose. Alternately, the rigid wand 144 may not have air flow therethrough. In such a case, the rigid wand 144 may function as a support member and an air flow member, such as a flexible hose, may be provided, e.g., external to the rigid wand 144 to connect the hand vacuum cleaner 112 in flow communication with the surface cleaning head 104.

Figure 3:
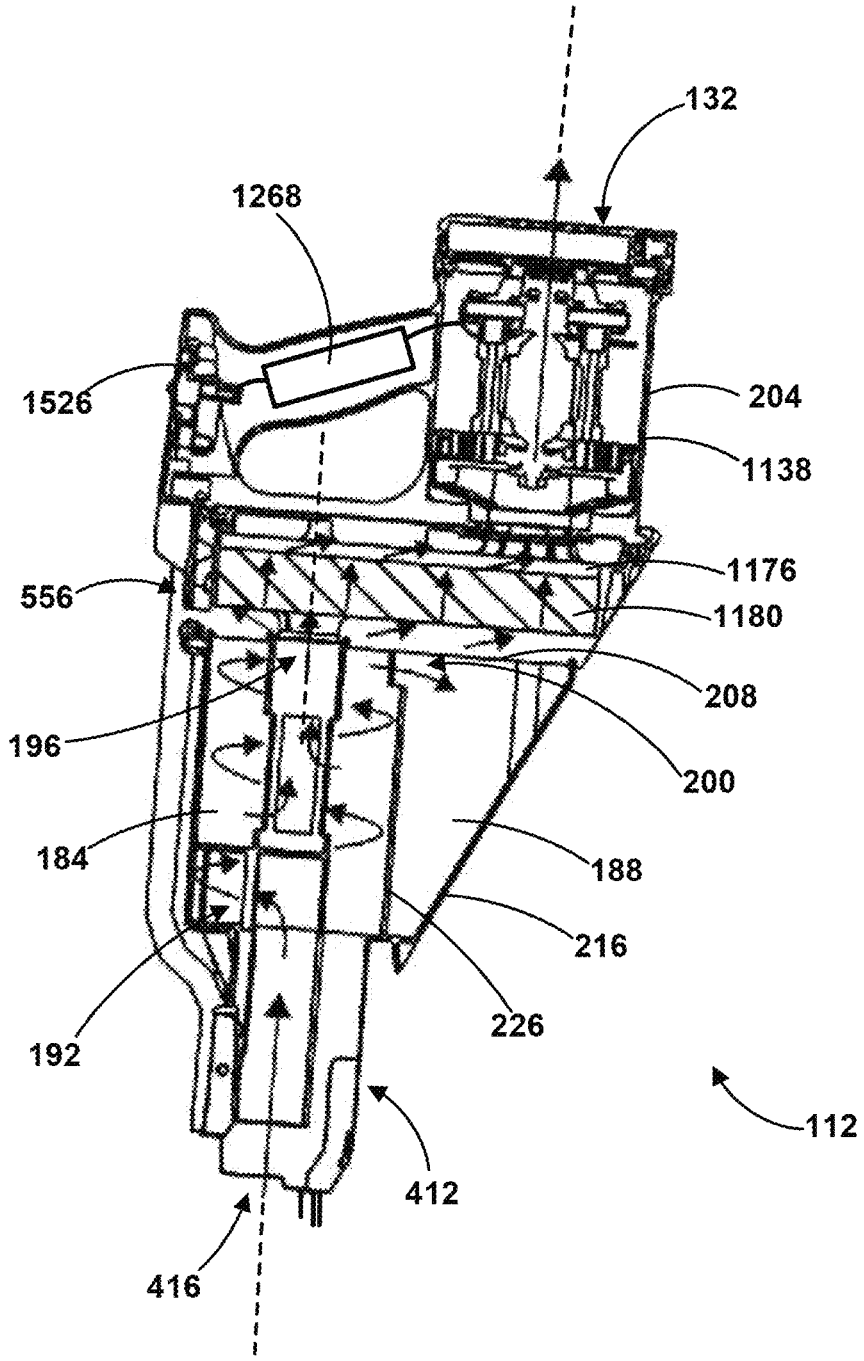
FIG. 3 is an enlarged cross sectional view of a portion of the surface cleaning apparatus of FIG. 2.

The cyclone chamber or chambers and the dirt collection chamber or chambers may be of any design. Referring to FIG. 3, in the illustrated example the cyclone chamber 184 includes an air inlet 192 (a cyclone or air treatment member air inlet) in fluid communication with wand 144, an air outlet 196 downstream of air inlet 192, and a dirt outlet 200 in fluid communication with dirt collection chamber region in the form of a dirt collection chamber 188. Suction motor 204 or another suction source may draw dirty air to enter air inlet 192 and travel cyclonically across cyclone chamber 184 to dirt outlet 200 where dirt is ejected into dirt collection chamber 188. Afterwards, the air is discharged from cyclone chamber 184 at air outlet 196.

The dirt collection chamber 188 may include a bottom wall 216, side walls 208, and interior wall 226 (which in the illustrated example is shared with the cyclone chamber 184). Optionally, the bottom wall 216 may be openable to empty the dirt collection chamber 188.

As exemplified, a pre-motor filter housing may be provided in the airflow path between the air treatment member and the suction motor for directing the airflow through one or more pre-motor filters preferably comprising physical filter media contained therein and/or a post motor filter housing may be provided in the airflow path between the suction motor and the clean air outlet for directing the airflow through one or more pre-motor filters preferably comprising physical filter media.

Referring to FIG. 3, in the illustrated example the handvac 112 has a pre-motor filter chamber 556 containing pre-motor filters 1176 and 1180, and a suction motor housing 1138 containing the suction motor 204. The airflow path from inlet nozzle 412 to clean air outlet 132 may extend downstream from cyclone bin assembly 136 to pre-motor filter chamber 556 to suction motor housing 1138. That is, cyclone bin assembly 136, pre-motor filter chamber 556, and suction motor housing 1138 may be positioned in the airflow path with pre-motor filter chamber 556 downstream of cyclone bin assembly 136 and suction motor housing 1138 downstream of pre-motor filter chamber 556.

In accordance with an aspect of this disclosure, which may be used by itself or in combination with any one or more other aspects of this disclosure, the surface cleaning apparatus is reconfigurable to operate in a plurality of different modes of operation. For example, the surface cleaning apparatus may be operable in two or more of a portable handvac mode, a stair-cleaning mode, an above-floor cleaning mode, at least one floor cleaning mode, or a dual motor floor cleaning mode. In some cases, the surface cleaning apparatus may be reconfigurable between different modes of operation with a single act of connection or disconnection. This may permit the surface cleaning apparatus to be quickly reconfigured with minimal interruption.

Referring to FIG. 1, the surface cleaning apparatus 100 is shown in a floor cleaning mode, in which the dirty air inlet 124 is fluidly connected to the handvac 112. Optionally, when the handvac 112 is detached from the upper portion 108, as illustrated in FIG. 3, it can be used in a portable, above floor cleaning mode, which is referred to as a portable handvac mode, in which upstream end 416 may function as a handvac air inlet. Alternately, or in addition, the surface cleaning apparatus 100 may be configured in an alternate above floor cleaning mode in which the handvac 112 remains attached to a downstream end of the wand 144, and the upstream end 496 of the wand 144 is detached from the surface cleaning head. In this configuration a user need not carry the weight of the surface cleaning head, and may benefit from an extended above-floor cleaning reach as the wand 144 may provide extended reach for distant cleaning surfaces (e.g. curtains, and ceilings). An auxiliary cleaning tool such as a crevice tool, brush or the like may be attached to the inlet end 496 of the wand. In the stair cleaning mode, the hand vac 112 may be connected directly to surface cleaning head 104.

Optionally, the apparatus 100 may be reconfigured to a handvac mode from any other mode of operation by disconnecting handvac 112 from other parts of the apparatus (e.g. from wand 144). Referring to FIG. 3, as illustrated, the handvac mode may include handvac 112 alone. In the handvac mode, upstream end 416 of nozzle 412 may provide the dirty air inlet. Optionally, one or more accessories (not shown), such as a brush, crevice tool, or auxiliary wand may be connected to nozzle 412.

In this configuration, the nozzle 412 on the handvac 112 is detached from the upper portion 108 and can serve as a second, auxiliary dirty air inlet. In this mode, a user need not lift or manipulate the weight of the upper portion 108 or surface cleaning head 104 while using the handvac 112. The handvac mode of apparatus 100 may be lighter, smaller, and more agile than the other modes of operation. In addition, the length air flow path is reduced and therefore the back-pressure is reduced. Accordingly, a less powerful motor may be used to provide good cleaning efficiency in this mode.

In some cases, a user may wish to momentarily disconnect handvac 112 for use in the handvac mode (e.g. to clean a surface that is more accessible in the handvac mode), and then return the apparatus to the previous mode. For example, apparatus 100 may be momentarily reconfigured from the floor cleaning mode to the handvac mode, merely by removing the handvac, and afterward reconfigured again to the floor cleaning mode.

As exemplified, the connection between the nozzle 412 and the wand 144 may also include an electrical connection 1530 (FIG. 1, such as a mating prongs and sockets) that can transfer electrical power from the handvac 112 to the upper portion 108 and ultimately the surface cleaning head 104 (for example to power motors, lights and other devices). Detaching the handvac 112 from the wand 144 disengages the connection 1530, which can sever the electrical connection. Severing the electrical connection in this manner may cause all powered devices in the upper portion 108 or surface cleaning head 104 to be automatically de-energized when the handvac 112 is detached. This may help inhibit the operation of any such devices (e.g., a brush motor) when the handvac 112 is not fluidly connected to the upper portion 108. In such an embodiment, an electrical cord which is connectable with a household power outlet may be provided on the hand vac. Alternately, the electrical cord may be provided on the rest of the vacuum cleaner (e.g., surface cleaning head 104) whereby current to operate motor 204 may be supplied from the surface cleaning head, up the wand 144 to the hand vac. As discussed in more detail below, the hand vac may accordingly include an on board power supply (e.g., one or more batteries) to power the hand vac when removed from the surface cleaning head 104.

In accordance with another aspect of this disclosure, which may be used by itself or in combination with any one or more other aspects of this disclosure, the surface cleaning head or upright section of the surface cleaning apparatus may include one or more batteries for powering the handvac when the handvac is connected to the surface cleaning head or upright section. The handvac may also include handvac batteries which may power the handvac when connected to or disconnected from the upright section and surface cleaning head (e.g. in an above-floor cleaning mode or handvac mode). When the handvac is electrically connected to the surface cleaning head, the batteries in the surface cleaning head may supplement the batteries in the handvac or be the sole power source.

Figure 4:
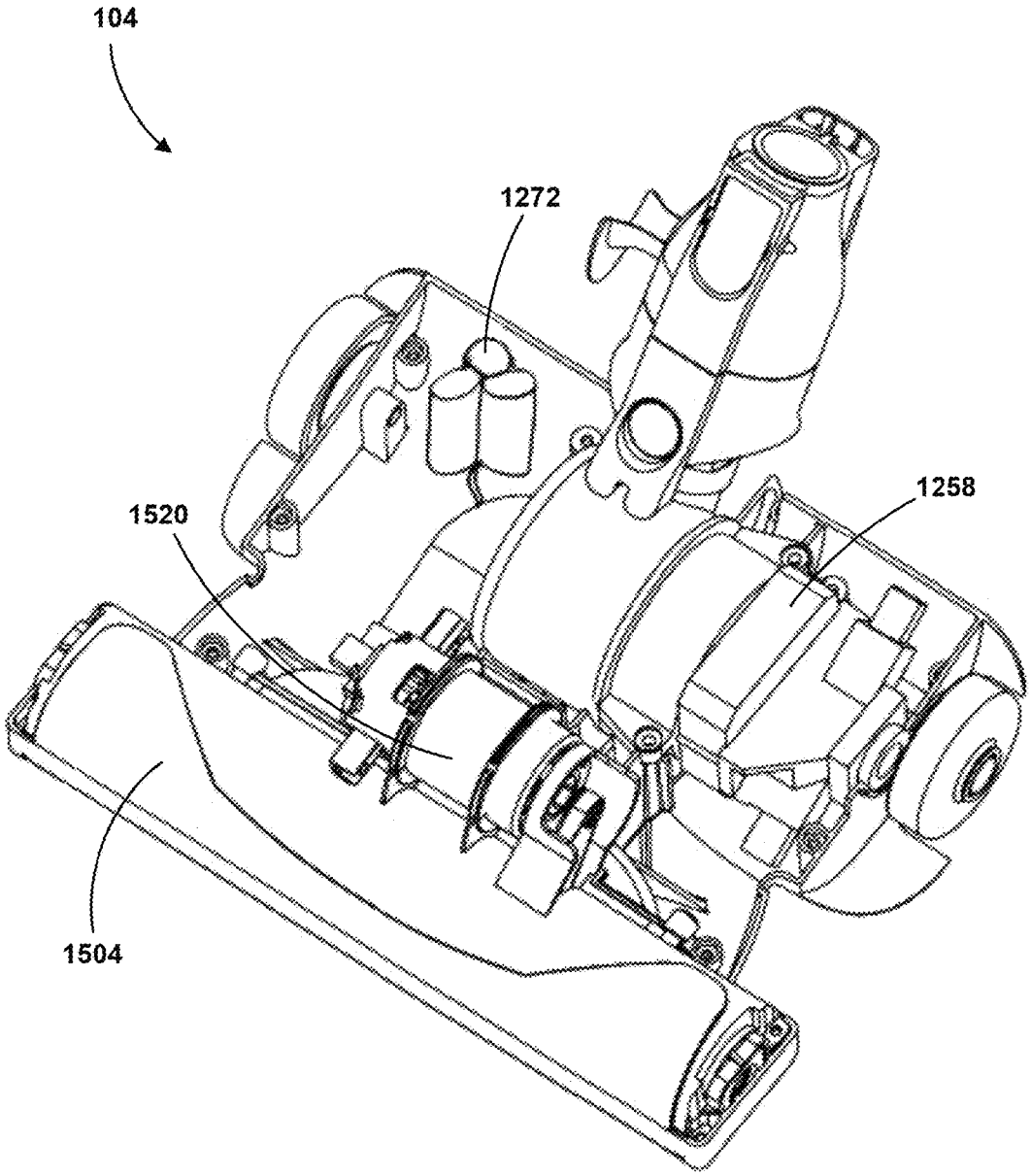
FIG. 4 is a cross-sectional view of a portion of the surface cleaning apparatus of FIG. 1, taken along line 4-4 which is shown in FIG. 1.

As exemplified in FIGS. 3 and 4, surface cleaning apparatus 100 may include one or more handvac batteries 1268 mounted to the handvac 112, and one more supplemental batteries 1272. Supplemental batteries 1272 may be mounted to any other suitable component of apparatus 100 other than handvac 112. For example, supplemental batteries 1272 are shown mounted to surface cleaning head 104. Alternatively or additionally, supplemental batteries 1272 may be mounted to upright section 108.

As used herein, the plural term "batteries" means one or more batteries. For example, supplemental batteries 1272 may be one battery or a plurality of batteries. Similarly, handvac batteries 1268 may be one battery or a plurality of batteries. Batteries 1272 and 1268 may be any suitable form of battery such as NiCad, NiMH, or lithium batteries, for example. Preferably, batteries 1272 and 1268 are rechargeable, however, in alternative embodiments, one or both of batteries 1272 and 1268 may be non-rechargeable single-use batteries.

Optionally, when handvac 112 is connected to upright section 108, an electrical connection may be formed between supplemental batteries 1272 and handvac 112, e.g. for powering suction motor 204.

In some embodiments, supplemental batteries 1272 may provide handvac 112 with enhanced power for generating greater suction with suction motor 204. For example, suction motor 204 may operate in a high power consumption mode, drawing power from supplemental batteries 1272, or supplemental batteries 1272 and handvac batteries 1268 simultaneously.

In some embodiments, supplemental batteries 1272 may provide the handvac 112 with extra energy for prolonged cleaning time between charges. For example, supplemental batteries 1272 may have a greater energy capacity (e.g. measured in Watt-hours) than handvac batteries 1268, such that handvac 112 may be sustained by supplemental batteries 1272 for a longer operating time. In some embodiments, handvac 112 may draw power from both of supplemental batteries 1272 and handvac batteries 1268, which have a greater combined energy storage capacity than handvac batteries 1268 alone.

In some embodiments, supplemental batteries 1272 may supply power to the handvac in preference to the handvac batteries 1268 to delay or avoid draining the handvac batteries 1268. For example, handvac 112 may draw power from supplemental batteries 1272 until substantially depleted before drawing power from handvac batteries 1268. This may conserve power in handvac batteries 1268 for use when handvac 112 is disconnected from supplemental batteries 1272 (e.g. in an above-floor cleaning mode, or handvac mode of apparatus 100). In some embodiments, handvac 112 may never draw power from handvac batteries 1268 when handvac 112 is electrically connected to supplemental batteries 1272.

In some embodiments, handvac 112 may draw power from supplemental batteries 1272 to recharge handvac batteries 1268. This may help to ensure that handvac batteries 1268 are not depleted when handvac 112 is disconnected from supplemental batteries 1272 (e.g. for use in an above-floor cleaning mode, or handvac mode of apparatus 100). In some cases, supplemental batteries 1272 may recharge handvac batteries 1268 only when apparatus 100 is not turned on.

In some embodiments, supplemental batteries 1272 may be recharged whenever the surface cleaning apparatus is connected to an external power outlet. In some cases, handvac batteries 1268 may be recharged when handvac 112 is electrically connected to an external power outlet (e.g. when surface cleaning head 104 or upright section 108 is connected to a power outlet by an electrical cord (not shown), and handvac 112 is connected to the surface cleaning head 104 or upright section 108).

In accordance with another aspect of this disclosure, which may be used by itself or in combination with any one or more other aspects of this disclosure, the surface cleaning apparatus may include two or more suction motors in communication with a common air flow path, and optionally in communication with a single air treatment member. Optionally, one suction motor can be provided in the air flow path upstream from the air treatment member and another suction motor can provided in the air flow path downstream from the vacuum cleaning unit. The suction motors may be different from each other, and may operate to generate different amounts of suction. The relative performance of each suction motor can be selected to help facilitate desired operation/airflow characteristics along the air flow path. Optionally, different portions of the air flow path can have different pressures and different air flow rates. Accordingly the suction motors co-operate to convey air through the air treatment member to the clear air outlet For example, the suction motors may be configured so that the air flow path is operated at generally constant conditions along its length. Alternatively, the suction motors can be operated so that the air flow path has some regions of relatively high suction/air flow, and some regions of relatively low suction/air flow.

Optionally, when both suction motors are in use, a first portion of the air flow path upstream from the first suction motor may be operated at a first operating pressure, a second portion of the air flow path between the first and second suction motors may be operated at a second operating pressure. The first and second operating pressures may be the same, or they may be different. Optionally, the first and second portions may be maintained at an operating pressure that is less than atmospheric pressure. In this configuration, any leaks in the air flow path will tend to draw in air from the surrounding environment, rather than leaking dirty air out of the air flow path into the environment. Alternatively, the second suction level can be higher than atmospheric pressure.

The suction motors may be provided in any suitable portion of the surface cleaning apparatus. Optionally, one suction motor can be provided in the handvac, and another suction motor can be provided in the upper section or surface cleaning head. In such a configuration, when the handvac is detached for independent use the second suction motor can be left behind and need not be carried by the user.

Optionally, the surface cleaning apparatus 100 may include two or more suction motors operating in series. In one aspect, this may enhance the suction at dirty air inlet 124 and/or compensate for suction loss from air flow through the surface cleaning head and the up flow duct.

Figure 2:
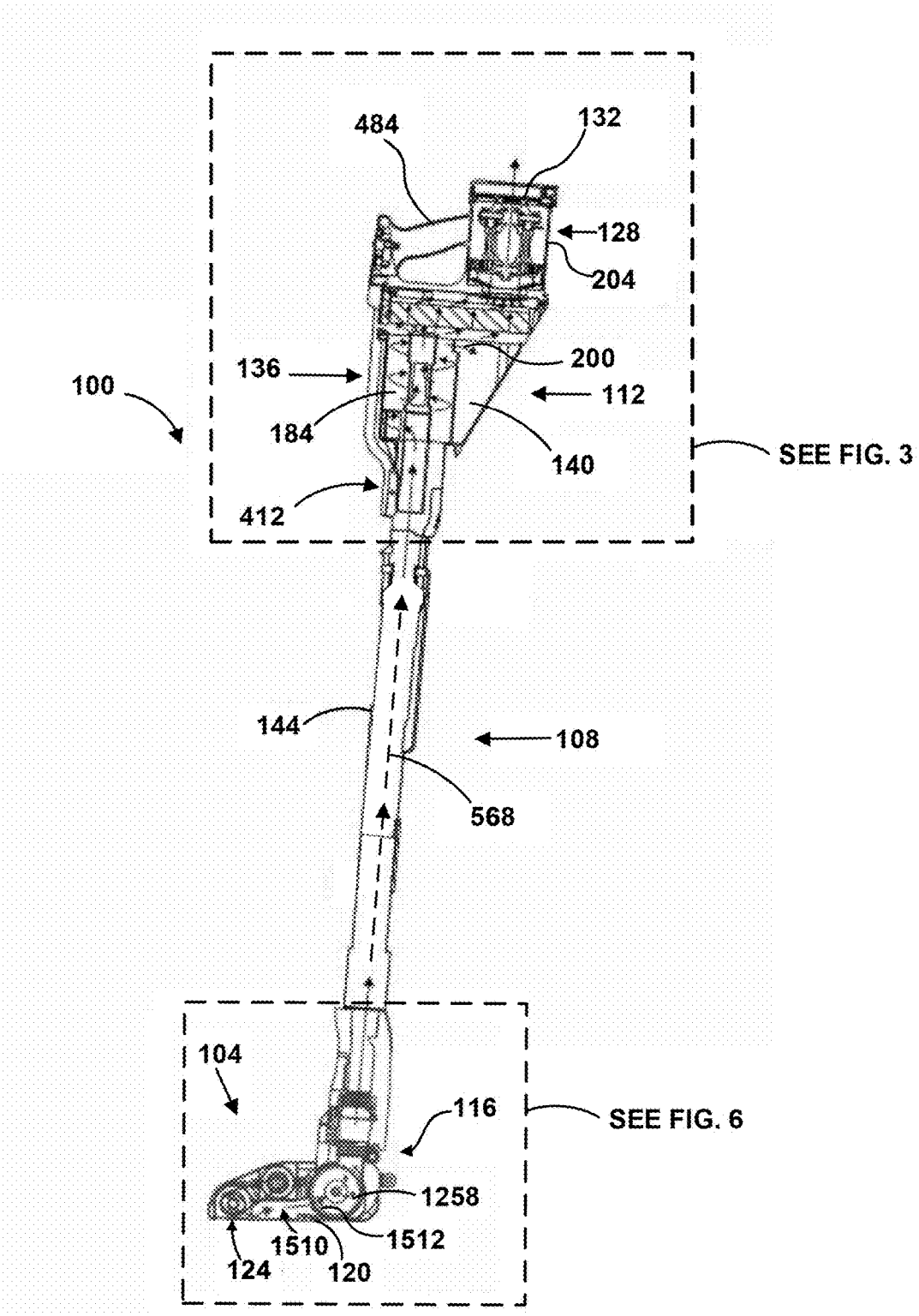
FIG. 2 is a cross-sectional view of the a surface cleaning apparatus of FIG. 1, taken along line 2-2 which is shown in FIG. 1.

Referring to FIG. 2, in the illustrated example the surface cleaning apparatus includes a first suction motor 1258 that may be positioned in the airflow path between dirty air inlet 124 and handvac 112. For example, first suction motor 1258 may be a dirty air suction motor that is located upstream from the cyclone bin assembly 136 and is positioned in surface cleaning head 104. As shown, dirty air entering dirty air inlet 124 may be drawn through first suction motor 1258 before the airflow flows up the wand 144 to the cyclone bin assembly 136 in the handvac 112, travels through the handvac or second suction motor 204 and is ultimately exhausted through the clean air outlet 132.

Figure 5:
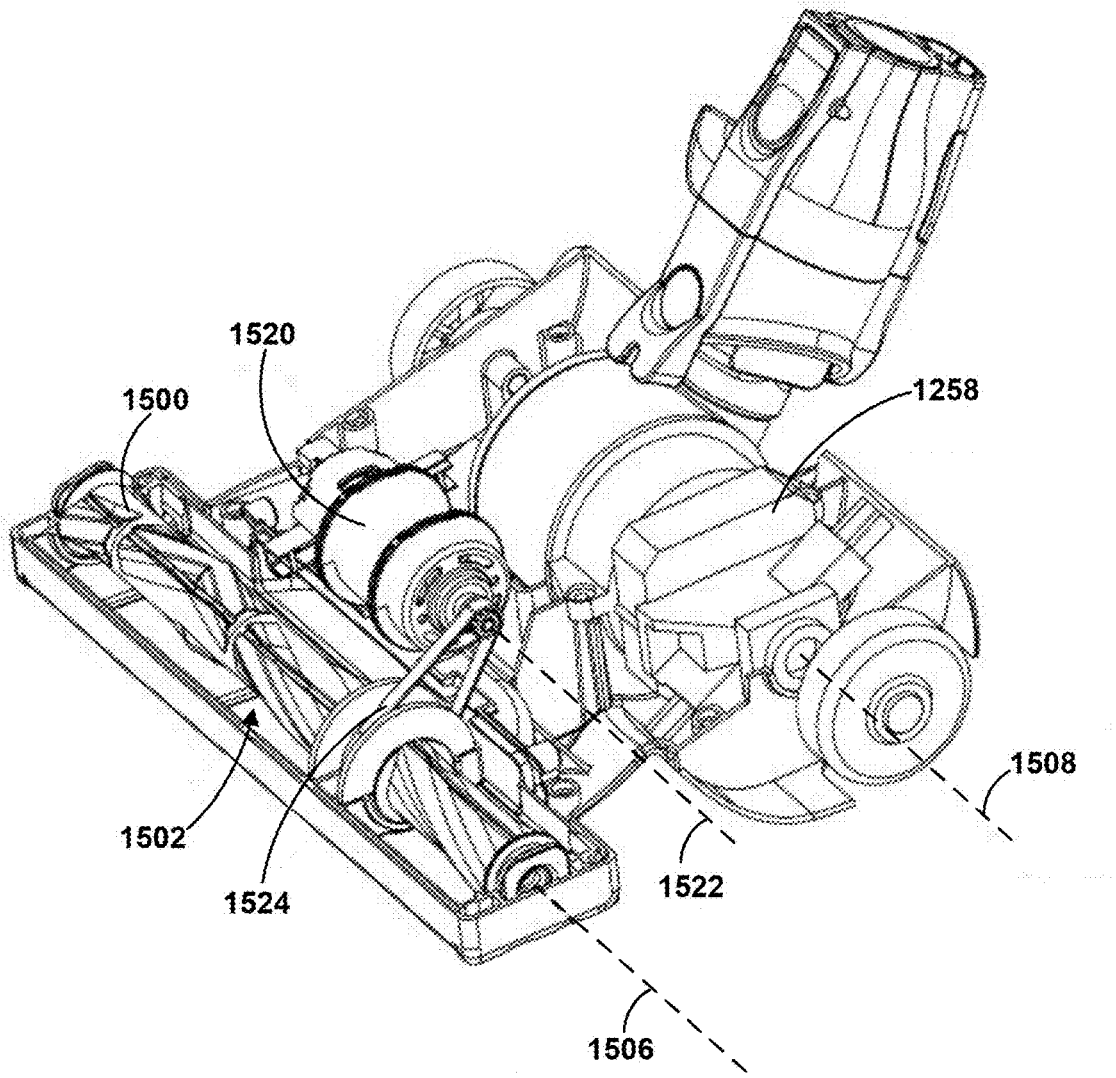
FIG. 5 is another view of the portion of the surface cleaning apparatus of FIG. 4, with a brush cover removed.
Figure 6:
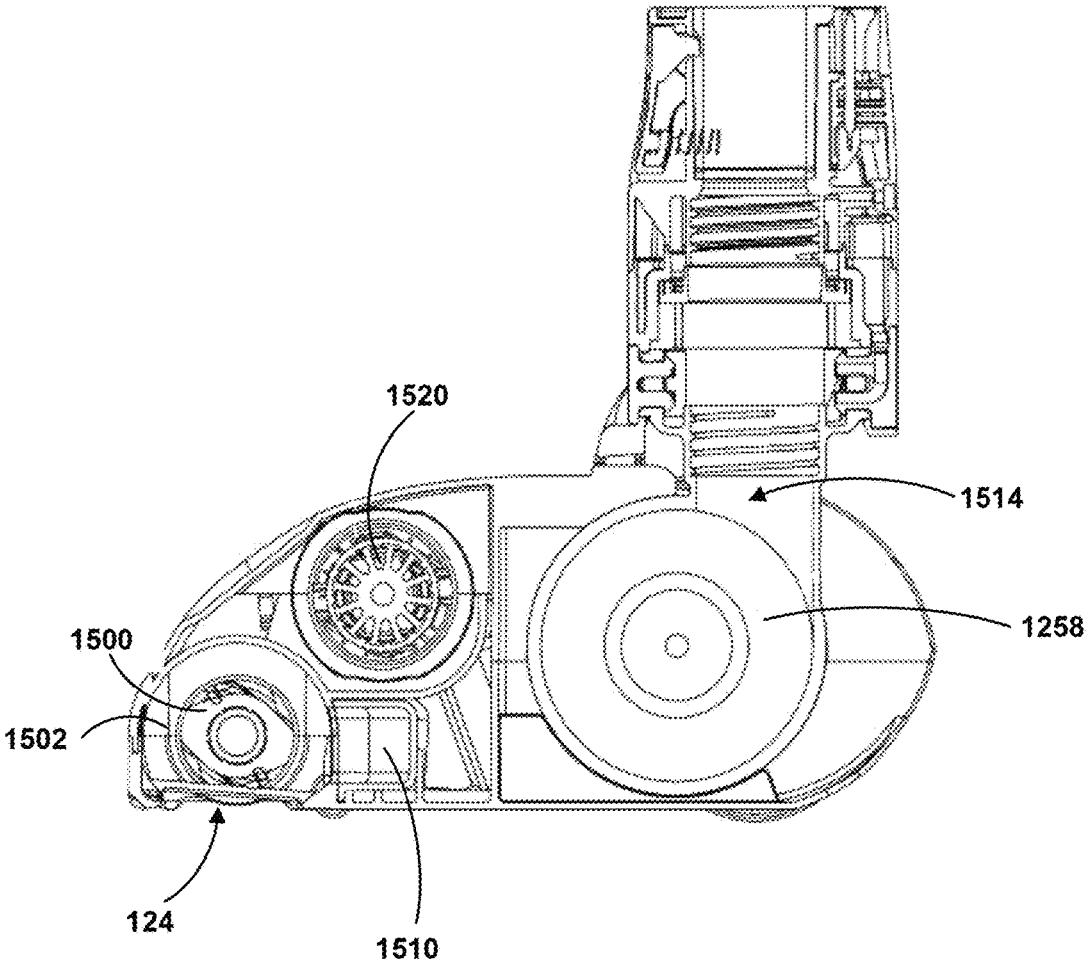
FIG. 6 is a cross-sectional view of a portion of the surface cleaning apparatus of FIG. 1, taken along line 2-2 which is shown in FIG. 1; and, FIG. 7 is a schematic representation of one example of an air flow path through the surface cleaning apparatus of FIG. 1.

Referring to FIGS. 4-6, in the illustrated example the surface cleaning head 104 contains the first suction motor 1258 and an optional rotatable cleaning brush 1500 in a brush chamber 1502. The bottom side of the brush chamber 1502 is open to provide the dirty air inlet 124. The brush chamber 1500 is shown with an upper cover 1504 in place in FIG. 4, and with the cover 1504 removed in FIG. 5. The brush 1500 is rotatable about a brush axis 1506 (FIG. 5), which in the example illustrated extends laterally and horizontally, and is generally parallel to the pivot axis 1508 about which the upper section 108 can pivot. As exemplified in FIG. 5, the first suction motor 1258 may be oriented such that its motor axis is co-axial with the pivot axis 1508.

An air flow conduit 1510 (see also FIG. 2) extends from the brush chamber 1502 to the air inlet 1512 of the first suction motor 1258. When the apparatus 100 is in use, dirty air and debris from the ground is sucked in via the dirty air inlet 124 and flows through the conduit 1510 to the first suction motor 1258, without first passing through a filter or other type of air treatment member. Accordingly, first suction motor 1258 may be referred to as a dirty air motor. The air then exits the first suction motor 1258 via an air outlet 1514, which can be fluidly connected to the upstream end 496 of the wand 144. The air, which is still dirty and carrying debris, may then flow through the wand 144 to reach the handvac 112 and to enter the cyclone bin assembly 136. Once treated in the cyclone bin assembly 136, the air can continue through the pre-motor filters 1176 and 1180 and into the suction motor 204 in the handvac 112. Accordingly second suction motor 204 may be referred to as a clean air motor. It will be appreciated that, as exemplified, the air flow path between dirty air inlet 124 and the air treatment member in handvac 112 may be free from physical media filtration members.

Figure 7:
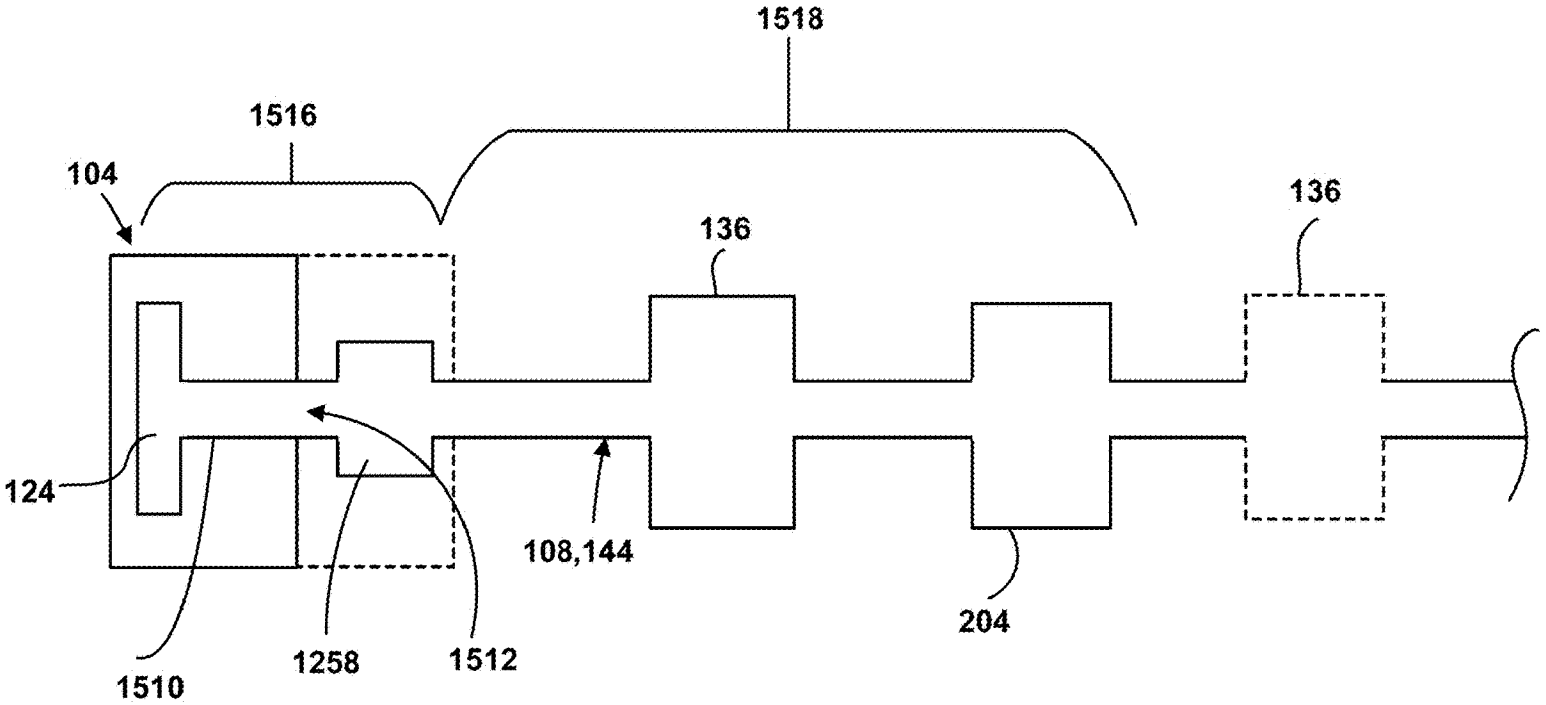

Referring also to FIG. 7, in the illustrated example, the conduit 1510 forms a first portion 1516 of the air flow path (i.e. upstream from first suction motor 1258), and the upper portion 108, wand 144 and preferably the air treatment member (e.g. cyclone bin assembly 136) form a second portion 1518 of the air flow path (i.e. between the suction motors 1258 and 204). Optionally, the air treatment member 136 may be positioned downstream from the suction motor 204 in the handvac 112 (as indicated by the use of dashed lines in FIG. 7). In such a configuration, both motors 204 and 1258 may be upstream from the air treatment member and may be dirty air motors.

Optionally, the surface cleaning apparatus 100 may be configured so that the second suction motor 204 is capable of maintaining a vacuum in all or a portion of the second portion 1518 of the air flow path while the first suction motor 1258 is in use. For example, when the first and second suction motors 1258 and 204 are in use, the air pressure at the air inlet of the vacuum cleaner unit 112 and/or the air inlet to the air treatment member in the vacuum cleaner unit 112 may be less than atmospheric pressure. For example, the pressure may be less than 2 inches of water, less than 1 inch of water, less than 0.5 inches of water or less than 0.25 inches of water.

Optionally, one or more supplemental air inlets (for example bleed valves) can be provided in the second portion 1518 to provide a supplemental source into the air flow path, downstream from the suction motor 1258, to help ensure the motor 204 receives adequate air flow regardless of the state of suction motor 1258.

When operating in the floor cleaning mode (FIG. 1), dirty air drawn in through the dirty air inlet 124 is drawn through both suction motors 204 and 1258 as it flows through the air treatment member (cyclone bin assembly 136) on its way to the clean air outlet 132. Alternatively, when the handvac 112 is detached from the surface cleaning head 104, the second suction motor 1258 remains with the surface cleaning head 104. In this configuration, only the suction motor 204 is used convey the air through the air treatment member.

Referring to FIGS. 5 and 6, in the illustrated example the surface cleaning head 104 also includes a brush motor 1520 that is rotatable about a brush motor axis 1522. A drive belt 1524 may connect the brush motor 1520 to the brush 1500. As exemplified, the brush motor axis 1522 may be generally parallel to the brush axis 1506 and/or the pivot axis 1508 and or the axis of rotation of first suction motor 1258.

In the illustrated example, the air conduit 1510 connecting the brush chamber 1502 to the suction motor 1258 extends beneath the brush motor 1520. Positioning the brush motor 1520 so that it overlies at least a portion of the air conduit 1510 (i.e., a portion of the air flow passage extends underneath the brush motor) may help reduce the overall size of the surface cleaning head 104, while still enabling the brush motor 1520 to be drivingly connected to the brush 1500. In this configuration the brush motor 1520 is positioned between the suction motor 1258 and the brush 1500 in the forward/backward direction (i.e. the direction of travel of the surface cleaning head 104).

While illustrated as being contained within the surface cleaning head 104, the suction motor 1258 need not be within the cleaning head 104, and may be located on any other suitable portion of the surface cleaning apparatus 100, as indicated using the dashed lines in the representation of the cleaning head 104 in FIG. 7 (e.g., on the lower portion of rigid wand 144).

Optionally, the surface cleaning head 104 need not include the optional batteries 1272, and the only electrical power to drive the suction motor 1258 and brush motor 1520 may be provided by the handvac 112, via the upper section 108. In this configuration, detaching the handvac 112 may automatically interrupt the electrical supply to the surface cleaning head, and may automatically de-energize the suction motor 1258 and brush motor 1520. This may help prevent the suction motor 1258 and/or brush motor 1520 from operating when the air flow communication between the suction motor 1258 and the air treatment member is interrupted (i.e. when the handvac 112 is detached from the upper portion 108). Automatically disabling the suction motor 1258 in this manner may help reduce the likelihood of dirty air exiting the suction motor 1258 from being inadvertently blown out of the surface cleaning head 104 and fouling the surrounding area.

Optionally, the second suction motor 1258 may be operably independently from the suction motor 204. For example, the second suction motor 1258 may be turned on and off regardless of the state of the suction motor 204, and optionally vice versa. Alternatively, operation of the second suction motor 1258 may be linked to operation of the suction motor 204, such that when the suction motor 204 is off the second suction motor 1258 is off, and when the suction motor 204 is on the second suction motor 1258 is also on.

It will be appreciated that removing the hand vac from wand 144 may disconnect the hand vac from electrical communication with the wand 144. Therefore, even if a single switch is used to actuate both motors, separating the hand vac from the wand may result in the single switch actuating only hand vac suction motor 204. For example, referring to FIG. 1, the handvac 112 may include a primary on/off switch 1526 that is provided, e.g., at the upper end of the handle 484. When the handvac 112 is attached to the upper portion 108, the switch 1526 may be electrically connected to both suction motors 204 and 1258, such that moving the switch to an "on" position can turn on both motors 204 and 1258, and when the switch is moved to an "off" position, both motors 204 and 1258 are may be switched off. This may help facilitate one-handed operation of the surface cleaning apparatus 100, as a user can control operation of both motors 204 and 1258 using switch 1526 which can be actuated using the same hand a user uses to grasp the handle 484. When the handvac 112 is detached from the upper portion, the connection between the switch 1526 and the suction motor 1258 is interrupted, but the switch 1526 can still be used to control the suction motor 204.

Optionally, when the handvac 112 is attached, the switch 1526 may also be operable to control operation of the brush motor 1520 and any other electrical devices (such as lights, etc.) that are provided on the upper portion 108 and/or surface cleaning head 104. Optionally, the switch 1526 may be a multi-position switch such that the brush motor 1520 may be controlled independently from the second suction motor 1258.

The surface cleaning apparatus 100 may be operated in a variety of different operating modes. For example, the apparatus 100 may be operated in a first floor cleaning mode in which both motors 1258 and 204 are in use. This may help provide a relatively high amount of suction at the dirty air inlet 124. The apparatus 100 may be operated in an alternative floor cleaning mode in which only one of the suction motors 204 and 1258 is in use, and the other of the motors 204 and 1258 is de-energized. For example, when the handvac 112 is attached, the motor 1258 may be on while the motor 204 is off. In this configuration, the portion of the air flow path between the motor 1258 and the motor 204 may be at higher than atmospheric pressure. Alternatively, if the motor 204 is on and the motor 1258 is off, the same portion of the air flow path may be at lower than atmospheric pressure. Optionally, as described herein, when both motors 204 and 1258 are on, the portion of the air flow path between the motors 204 and 1258 may be maintained at a pressure that is higher, lower or generally equal to atmospheric pressure.

Optionally, the apparatus 100 can be configured so that when the switch 1526 is in the "on" position the handvac 112 may be detached and from the upper portion 108, and re-attached to the upper portion 108, while the suction motor 204 is operating. This may help facilitate a relatively easy transition between the floor cleaning mode and a portable or above floor cleaning mode.

Optionally, the apparatus 100 may be configured so that if the second suction motor 1258 is in use when the handvac 112 is detached from the upper portion 108, the second suction motor 1258 will be turned off when the electrical connection between the handvac 112 and the upper portion 108 is severed (regardless of the position of the switch 1526). The apparatus may also be configured so that if the switch 1526 is in the "on" position when the handvac 112 is re-attached to the upper portion 108 the second suction motor 1258 will turn on automatically, without the need for a user to engage a second switch or re-position the switch 1526.

Alternatively, the surface cleaning apparatus 100 may be provided with a secondary power switch provided on the upper portion 108 or surface cleaning head 104. The secondary power switch may be used to control the second suction motor 1258 independently, such that re-attaching the handvac 112 with the switch 1526 in the "on" position does not immediately engage the second suction motor 1258.

While the embodiments described herein have been in the context of a stick-type vacuum with a removable handvac, other types of surface cleaning apparatuses may also utilize the features described herein. For example, an upright vacuum cleaner may include one suction motor in its upper section (or optionally in a portable vacuum cleaner unit mounted to the upper portion) and a second suction motor in the surface cleaning head. The air flow path through the apparatus could have the same general configuration as illustrated schematically in FIG. 7, and could utilize some or all of the features described herein. Alternatively, a canister-type vacuum may include one suction motor in the canister portion and a second suction motor in the surface cleaning head.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

I claim:

1. A stick vacuum cleaner comprising:

a) a surface cleaning head having a dirty air inlet;

b) an air flow path extending from the dirty air inlet to a clean air outlet;

c) a rigid air flow conduit moveably mounted to the surface cleaning head between a storage position and a floor cleaning position, d) a first suction motor in the air flow path downstream from the dirty air inlet and upstream from the clean air outlet, the first suction motor is disposed in the surface cleaning head or on the rigid air flow conduit; and, e) a hand vacuum cleaner comprising a handle, an air inlet, an air treatment member having an air treatment member air inlet and a second suction motor downstream from the air treatment member and upstream from the clean air outlet, the hand vacuum cleaner is removaby mounted to a downstream end of the rigid air flow conduit, wherein when the hand vacuum cleaner is mounted to the rigid air flow conduit, the handle is drivingly connected to the surface cleaning head wherein, when the hand vacuum cleaner is mounted to a downstream end of the rigid air flow conduit, the first and second suction motor are operational in series.

2. The stick vacuum cleaner of claim 1, wherein the first suction motor and second suction motor co-operate to convey air through the air treatment member to the clear air outlet.

3. The stick vacuum cleaner of claim 1, wherein a portion of the air flow path extending from the first suction motor to the second suction motor is at a pressure less than atmospheric pressure when the first and second suction motors are in use.

4. The stick vacuum cleaner of claim 3, wherein when the first and second suction motors are in use, the air pressure at the air inlet of the hand vacuum cleaner is less than atmospheric pressure.

5. The stick vacuum cleaner of claim 3, wherein when the first and second suction motors are in use, the air pressure at the air inlet of the hand vacuum cleaner is less than 2 inches of water.

6. The stick vacuum cleaner of claim 1, wherein all of the air flow path extending from the first suction motor to the second suction motor is at a pressure less than atmospheric pressure when the first and second suction motors are in use.

7. A surface cleaning apparatus comprising:

a) a surface cleaning head having a dirty air inlet;

b) an air flow path extending form the dirty air inlet to a clean air outlet;

c) an upright section movably mounted to the surface cleaning head, the upright section moveable between a storage position and a floor cleaning position, d) a first suction motor in the air flow path downstream from the dirty air inlet and disposed in one of the surface cleaning head and the upright section;

e) a portable vacuum cleaner unit in the air flow path downstream from the first suction motor and comprising an air inlet, an air treatment member having an air treatment member air inlet and a second suction motor downstream from the air treatment member and upstream from the clean air outlet, the first suction motor and second suction motor co-operate to convey air through the air treatment member to the clear air outlet; and, f) a power switch on the portable vacuum cleaner unit, wherein when the portable vacuum cleaner unit is attached to the upright section, the power switch controls operation of the first suction motor and the second suction motor, and when the portable vacuum cleaner unit is detached from the upright section, the power switch controls operation of the second suction motor.

8. The apparatus of claim 7, wherein the portable vacuum cleaner unit is detachably mounted to the upright section and the surface cleaning apparatus is operable in a floor cleaning mode in which the portable vacuum cleaner unit is mounted to the upright section and the portable vacuum cleaner unit is operable in a portable mode wherein the portable vacuum cleaner unit is detached from the upright section.

9. The apparatus of claim 7, wherein the first suction motor is disposed within the surface cleaning head.

10. The apparatus of claim 9, wherein the surface cleaning head further comprises a rotatable brush positioned adjacent the dirty air inlet and a brush motor drivingly connected to the rotatable brush.

11. The apparatus of claim 10, wherein the rotatable brush rotates about a brush axis and the first suction motor rotates about a first motor axis that is generally parallel to the brush axis.

12. The apparatus of claim 11, wherein the brush motor rotates about a brush motor axis that is parallel to the brush axis and the first motor axis.

13. The apparatus of claim 10, wherein the surface cleaning head further comprises an inlet air passage extending from the dirty air inlet to the first suction motor wherein at least a portion of the inlet air passage extends underneath the brush motor.

14. The apparatus of claim 7, wherein the portable vacuum cleaner unit comprises the clean air outlet and the vacuum cleaning unit further comprises a pre-motor filter positioned external to the air treatment member and positioned in the air flow path downstream from the air treatment member and upstream from the second suction motor, and a post-motor filter is positioned in the air flow path downstream from the second suction motor and upstream from the clear air outlet.

15. The apparatus of claim 7, wherein the air treatment member comprises a cyclone.

16. The apparatus of claim 7, wherein a portion of the air flow path extending from the first suction motor to the second suction motor is at a pressure less than atmospheric pressure when the first and second suction motors are in use.

17. The apparatus of claim 7, wherein all of the air flow path extending from the first suction motor to the second suction motor is at a pressure less than atmospheric pressure when the first and second suction motors are in use.

18. The apparatus of claim 17, wherein when the first and second suction motors are in use, the air pressure at the air inlet of the portable vacuum cleaner unit is less than atmospheric pressure.

19. The apparatus of claim 17, wherein when the first and second suction motors are in use, the air pressure at the air inlet of the portable vacuum cleaner unit is less than 2 inches of water.

20. The apparatus of claim 17, wherein when the first and second suction motors are in use, the air pressure at the air treatment member air inlet is less than atmospheric pressure.

21. The apparatus of claim 17, wherein when the first and second suction motors are in use, the air pressure at the air treatment member air inlet is less than 2 inches of water.

22. The apparatus of claim 7, wherein a portion of the air flow path between the dirty air inlet and the air treatment member is free from physical media filtration members.

23. The apparatus of claim 7, wherein the upright section comprises a rigid wand having an upstream end connected to the surface cleaning head and forming part of the air flow path, the portable vacuum cleaner unit comprises a hand vacuum cleaner that is detachably mounted to an opposed downstream end of the rigid wand, and the rigid wand provides fluid communication between the first suction motor and the portable vacuum cleaner unit.

24. The apparatus of claim 23, wherein the portable vacuum cleaner unit further comprises a handle drivingly connected to the surface cleaning head.

25. The apparatus of claim 23, wherein the portable vacuum cleaner unit comprises a first power source to provide power to the second suction motor, and wherein the rigid wand comprises electrical connectors to transfer power from the portable vacuum cleaner unit to the surface cleaning head to power the first suction motor.

26. The apparatus of claim 25, wherein the portable vacuum cleaner unit is detachably mounted to the upright section and further comprising a power switch to control operation of the second suction motor, wherein the power switch is provided on and detachable with the portable vacuum cleaner unit, and wherein when the portable vacuum cleaner unit is mounted to the upper section the power switch also controls operation of the first suction motor.

27. The apparatus of claim 7, wherein the portable vacuum cleaner unit comprises a first power source to provide power to the second suction motor, and wherein the surface cleaning head comprises a second power source disposed within the surface cleaning head to provide power to the first suction motor.

* * * * *